US005131300A

United States Patent [19]

Daniel

[11] Patent Number: 5,131,300

[45] Date of Patent: Jul. 21, 1992

[54] OPENABLE AND CLOSABLE BOX WRENCH

[76] Inventor: Gordon S. Daniel, 3243 Rio Grande Trail, Kissimmee, Florida

[21] Appl. No.: 635,726

[22] Filed: Dec. 28, 1990

[51] Int. Cl.[5] ..... B25B 13/28

[52] U.S. Cl. ..... 81/111; 81/124.3; 81/124.6; 81/124.7; 81/DIG. 8

[58] Field of Search ..... 81/121.1, 124.3, 124.6, 81/124.7, 176.2, 176.3, 111, 98, DIG. 8

[56] References Cited

U.S. PATENT DOCUMENTS

| | | | |
|---|---|---|---|
| 1,411,970 | 4/1922 | Ligon | 81/124.3 X |
| 2,522,428 | 9/1950 | Brunstad | 81/DIG. 8 |
| 2,656,750 | 10/1953 | Rasco | 81/124.3 |
| 2,727,418 | 12/1955 | Moon | 81/124.3 |
| 3,008,363 | 11/1961 | Cook | 81/124.3 |
| 3,741,047 | 6/1973 | Kanowsky | 81/124.3 |
| 4,130,032 | 12/1978 | Giandomenico et al. | 81/119 |
| 4,688,454 | 8/1987 | Scull | 81/119 |
| 4,774,862 | 10/1988 | Scull | 81/119 |

*Primary Examiner*—James G. Smith
*Attorney, Agent, or Firm*—Chase & Yakimo

[57] ABSTRACT

A wrench is disclosed having hinged jaws which may be opened to be placed about an obstructed bolt, ferrule or other threaded connector. Once placed about the connector the jaws of the wrench are closed to provide contact between the interior flats of the wrench and the corresponding flats of the connector. Complemental elements moveable in parallel planes orthogonal to the jaws pivot axis and drive axis project from respective jaws and provide a means for engaging a torque-applying tool. Upon closure of the wrench jaws and elements are brought into register to permit attachment of the tool and thereby lock the hinged jaws of the wrench together.

6 Claims, 1 Drawing Sheet

OPENABLE AND CLOSABLE BOX WRENCH

BACKGROUND OF THE INVENTION

This invention relates to an openable and closable box wrench which may be applied to obstructed bolts or other connectors. In particular this invention relates to an openable box wrench the jaws of which may be opened and placed about an obstructed connector, reclosed and torque then applied.

The infinite variety of applications to which wrenches must be applied frequently presents situations in which access to a bolt head or nut is obstructed by adjoining structure. One such situation is in the tightening of nuts or ferrules which secure tubing to a second structure such as in aircraft engines. In this situation the tubing is received by a nut or ferrule which limits attachment of torque-applying devices to an open-ended wrench. Such an open-ended wrench is not the preferred means for tightening tubing. The incomplete contact of the open-ended wrench can unevenly distribute the torque to the ferrule and result in misalignment or uneven contact between the tubing and the member to which it is secured. Slipping of the wrench from incomplete contact of the wrench and nut can result in worker injury as well.

This situation is of particular importance in aircraft engines where fuel lines operating under extreme pressures and temperatures must be secured at very high torque ratings. In these applications the necessity for applying torque evenly and attaining such high forces makes open-ended wrenches particularly unsuitable. However, use of a device which completely encloses the threaded connector, such as a box wrench or a socket, is not possible due to the obstruction of the tubing through the center of the connector.

Accordingly, it is the primary object of the present invention to provide a means of capturing all sides of a threaded connector to allow even application of extremely high torque so as to avoid the above discussed problems.

It is another object of the present invention to provide a device which can completely enclose obstructed bolts, nuts and ferrules for tightening.

It is an additional object of the present invention to provide a wrench having movable griping jaws which can be rapidly and conveniently applied to an obstructed connector for tightening.

The above and further objects and novel features of the invention will more fully appear from the following description when the same is read in connection with the accompanying drawings.

DETAILED DESCRIPTION

Figure 1:
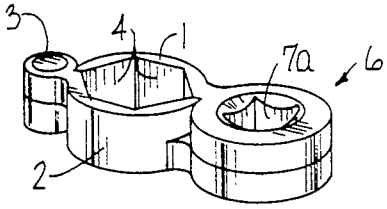
FIG. 1 is a perspective view of one embodiment of the invention showing the closed position of the wrench portion.
Figure 3:
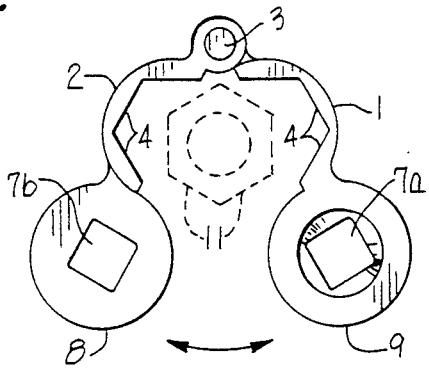
FIG. 3 is a plan view of the embodiment of FIGS. 1 and 2 showing the open position of the jaw members and a bolt head in broken lines.

Referring to FIG. 1, one embodiment of the invention is presented having opposing wrench jaws 1 and 2 interconnected at one end by a removable hinge pin 3. The wrench jaws 1 and 2 are oriented such that when in a closed operable position the wrench jaw flats 4 become aligned to contact the flats of a hex nut or tubing ferrule 11 (FIG. 3). The ends of jaw members 1 and 2 opposite the hinge 3 are integral with a tool-receiving head 6 containing apertures *7a* and *7b* for receiving a ratchet or other torque-applying tool.

Figure 2:
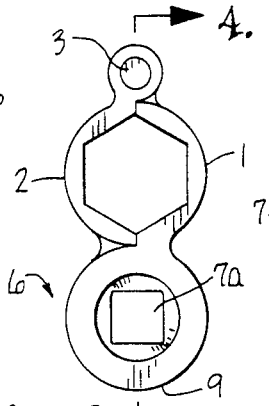
FIG. 2 is a plan view of the embodiment of FIG. 1 showing registration of the apertures which receive a torque-applying tool.

As will be apparent from examining FIGS. 2 and 3 in conjunction with one another the head 6 is split in a plane orthogonal to the hinge pivot axis and axis of rotation of nut 11 into an upper portion 9 and a lower portion 8 (FIG. 3) on respective jaw members 1 and 2. When the wrench jaws are open the head is separated as shown in FIG. 3 allowing the wrench to be placed about the obstructed nut or ferrule 11. Once the wrench has been placed around the obstruction the hinged jaws may be closed and the jaw flats 4 brought into substantial contact with the complemental flats of the nut or ferrule 11. When the wrench is closed the upper and lower portions 8 and 9 of the head 6 containing apertures *7a* and *7b* are in registration with one another to permit insertion of a torque-applying tool 15 (FIG. 4) into aligned apertures *7a* and *7b*.

When the torque-applying tool 15 (a ratcheting socket driver) is in place within the apertures *7a* and *7b* it extends through the upper and lower portions 9 and 8 of head 6 so as to lock together both portions of the head as well as jaws 1 and 2. When the head and jaws of the wrench are locked together, high torque may be applied to the wrench by means the torque-applying tool to achieve even distribution of pressure on the connector 11 as with a conventional box wrench or ratchet socket wrench.

Figure 4:
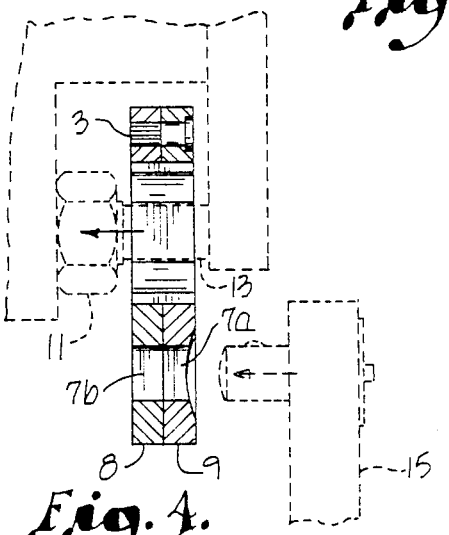
FIG. 4 is a cross section taken along line 4-4 in FIG. 2, showing the alignment of the wrench portion with respect to a connector and alignment of the apertures with a torque-applying tool, the connector and the tool being shown in broken lines.

Referring now to FIG. 4, it becomes apparent that the invention can be placed to capture a nut or ferrule which otherwise would only be accessible through the use of an open end wrench. FIG. 4 shows the invention after it has been opened and placed around the ferrule 11 obstructed by an inserted tube 13, the head portions or elements 8 and 9 having been brought into register so as to accept tool 15. It is important to note that hinge pin 3 being removable permits the disassembled jaw members 1 and 2 (FIG. 3) to first be separated for ease of placement about an obstructed nut as shown in FIG. 4. Once in place about the obstructed nut the pin may be reinserted. Alternatively, if the pin is fixed to one of the jaw members the jaw member without the pin may be removed and after placement around a nut reconnected to the jaw member having the pin attached. In FIG. 4 may also be seen the alignment of the head upper portion 9 and head lower portion 8 so as to bring apertures *7a* and *7b* into registration.

Figure 5:
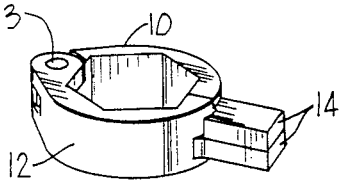
FIG. 5 is a perspective view of another embodiment of the invention showing the registrable lugs extending from the end of the jaws opposite the hinge end of the jaw members.
Figure 6:
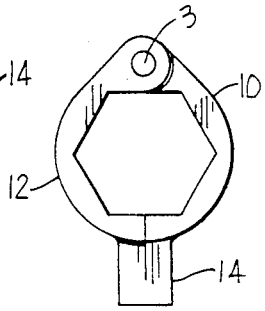
FIG. 6 is a plan view of the embodiment of FIG. 5.
Figure 7:
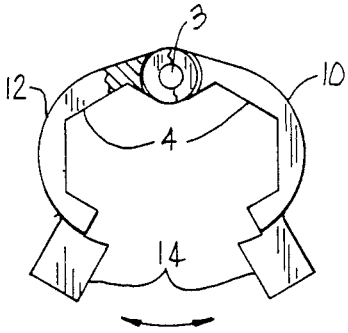
FIG. 7 is a plan view of the embodiment of FIG. 5 but showing the jaws in open position.

Referring now to FIGS. 5–7, an alternative embodiment of the present invention is shown. This embodiment is more suitable to situations in which extremely high torque must be delivered to a highly obstructed bolt or ferrule. A pair of outwardly projecting elements or lugs 14 on jaws 10 and 12, to which a torque-applying tool may be attached, are more compact and a direct extension from the jaws 10 and 12. This enables a more direct transfer of torque to the bolt or ferrule and provides for direct attachment of the torque-applying tool (not shown) which would comprise a female drive tool receiving the lugs 14. The precise registration between the upper and lower lugs 14 required by the splitting of the lugs in a plane orthogonal to the axis of rotation reduces potential for play in jaws 10 and 12 which could permit sliding of the wrench, resulting in damage to the bolt or ferrule flats or injury to the operator.

It is important to note that in each of the embodiments of the present invention the division of the tool-receiving end into two elements moveable in parallel planes which are orthogonal to the hinge pivot axis not only permits the separable jaws to be locked together upon registration of such elements but also equally distributes the torque delivered by the tool to both halves of the jaws of the wrench. When a tool is engaged with head 6 or lugs 14 it may been seen that whichever direction of rotation is selected, half of the force will be delivered to the jaw which will be pushing the bolt or ferrule in the direction of rotation and the other half of the force will be delivered to the opposing jaw. This distribution of the torque to both jaws 1 and 2 or 10 and 12 evenly communicates the rotational force onto both wrench jaws and thereby reduces the mechanical stress applied to hinge 3 and to head 6 or lugs 14 and substantially reduces the tendency of the jaw members to reopen as torque is applied as would occur were the neck or lugs split in a plane parallel to the axis of rotation.

It should also be appreciated that when the halves 8 and 9 of head 6 (or lugs 14) are brought into registration and the torque-applying tool is connected thereto, the jaws become locked. This locking of the jaws is provided for by the precise alignment of the apertures *7a* and *7b* or lugs 14 which are then fixed in place by the application of the torque-applying tool. This action maintains the jaws locked in the closed position as increased torque is applied to the wrench by the tool.

Figure 8:
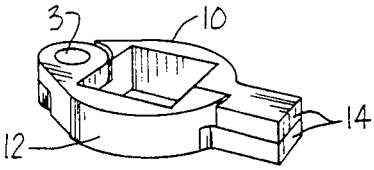
FIG. 8 is a perspective view of a modified form showing a rectangular internal configuration of the wrench.
Figure 9:
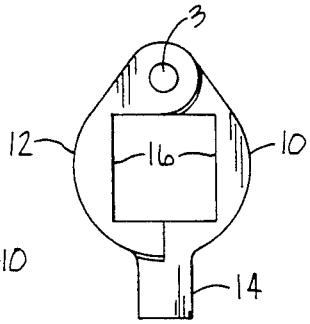
FIG. 9 is a plan view of the embodiment of FIG. 8.
Figure 10:
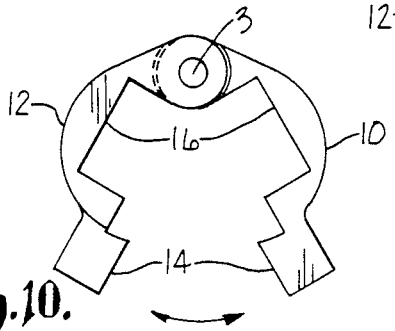
FIG. 10 is a plan view of the embodiment of FIG. 8 showing the jaws in open position.

In FIGS. 8, 9 and 10 a modified form of the invention is presented in which the interior flats 16 of the wrench are formed to be utilized upon a square head fastener. It should be evident that any type of wrench jaw internal flat configuration is included as possible alternatives of the present invention.

It is to be understood that while certain forms of this invention have been illustrated and described, it is not limited thereto, except insofar as such limitations are included in the following claims.

Having thus described the invention, what is claimed as new and desired to be secured by Letters Patent is:

1. A wrench comprising:

a pair of jaw members each having opposed ends, means on one of said end of each of said jaw members mounting the latter for movement about a pivot axis between open and closed positions, said jaw members having opposed wrench portions adapted for engagement with corresponding opposed flats of a connector when the jaw members are in their closed position, and means on the other ends of said jaw members for holding the jaw members closed during application of driving torque thereto, said holding means including complemental elements on respective jaw members movable along parallel, axially spaced planes orthogonal to the pivot axis and having a configuration causing said elements to move into registration with each other when said jaw members are closed, said elements upon registration thereof being adapted for engagement by a torque-applying tool.

2. The wrench as claimed in claim 1, wherein said mounting means includes a removable hinge component.

3. The wrench as claimed in claim 1, wherein said complemental elements on respective jaw members lock the jaw members in said closed position when engaged by said torque-applying tool.

4. The wrench as claimed in claim 1, wherein said elements on respective jaw members have tool-receiving apertures in register with one another and presenting a drive axis generally parallel to said pivot axis when the jaw members are closed.

5. The wrench as claimed in claim 1, wherein said elements include outwardly projecting male lugs of like configuration on respective jaw members in register with one another when the jaw members are closed, and adapted to be received by said torque-applying tool.

6. A wrench comprising:

a pair of jaw members each having opposed ends, means on one of said ends of each of said jaw members mounting the latter for movement about a pivot axis between open and closed positions, said jaw members having opposed wrench portions adapted for engagement with corresponding opposed flats of a connector when the jaw members are in their closed position, and means on the other ends of said jaw members for holding the jaw members closed during application of driving torque thereto, said holding means including complemental elements on respective jaw members movable along parallel planes orthogonal to the pivot axis and having tool-receiving apertures in register with one another presenting a drive axis generally parallel to said pivot axis when said jaw members are closed, said elements upon registration of said apertures being adapted for engagement by a torque-applying tool.

* * * * *